United States Patent [19]

MacGregor

[11] Patent Number: 4,682,959

[45] Date of Patent: Jul. 28, 1987

[54] FINE TRIM ADJUSTMENT FOR MANUALLY TILTED OUTBOARD MOTOR

[76] Inventor: Howard S. MacGregor, 19 Glendale Dr., Kissimmee, Fla. 32741

[21] Appl. No.: 792,103

[22] Filed: Oct. 28, 1985

[51] Int. Cl.[4] ..... B63H 5/12

[52] U.S. Cl. ..... 440/53; 248/640; 248/643

[58] Field of Search ..... 440/53, 54, 63, 64, 440/49; 248/640–643, 297.3; 24/499, 563, 545–547

[56] References Cited

U.S. PATENT DOCUMENTS

| | | | |
|---|---|---|---|
| 2,345,458 | 3/1944 | Caron | 414/428 |
| 2,695,718 | 11/1954 | Epps | 414/429 |
| 3,136,287 | 6/1964 | North | 248/640 |
| 3,279,449 | 10/1966 | Ellis | 24/546 |
| 3,716,650 | 2/1973 | De Mecquenem | 24/546 |
| 4,521,202 | 6/1985 | Nakahama | 440/53 |

*Primary Examiner*—Joseph F. Peters, Jr.
*Assistant Examiner*—C. T. Bartz
*Attorney, Agent, or Firm*—Julian C. Renfro

[57] ABSTRACT

A mounting bracket arrangement for a boat powered by an outboard motor having an elongate shaft housing, such that very slight increases in the tilt angle of the motor are made possible. My arrangement comprising a transom bracket adapted to be mounted on the transom of a boat, with the transom bracket including a pair of stern brackets mounted in spaced relation on the transom of a boat. The lower portions of the stern brackets each contain a spaced series of trim adjustment holes, with each hole in one of the stern brackets being in alignment with a corresponding hole in the other of the stern brackets. An elongate pin is adapted to extend between any selected, aligned pair of spaced holes in the stern brackets, with a portion of the elongate shaft housing of the outboard motor defining a saddle member designed to contact a portion of the elongate pin at a location inboard of the stern brackets. The elongate pin withstands a substantial part of the forward thrust applied to said saddle member when the outboard motor is delivering power, with the boater being able to apply fine grain corrective forces for trimming the boat, when the boat is at rest, by placing a sleeve of preascertained wall thickness over the pin. The selected sleeve only slightly increases the effective diameter of the elongate pin, and thus only slightly increases the distance between the center of the elongate pin and the saddle member. The tilt angle of the motor with respect to the transom of the boat is thus only slightly increased, resulting in improved performance and improved handling of the boat at selected speeds.

10 Claims, 8 Drawing Figures

FINE TRIM ADJUSTMENT FOR MANUALLY TILTED OUTBOARD MOTOR

BACKGROUND OF THE INVENTION

It is well known that the angle the drive shaft housing of an outboard motor bears to the transom of a boat is of considerable importance insofar as the boat performing properly in the water, and all who have been aboard a boat powered by an outboard motor have become aware that the boat often will underperform, and plow or squat, or sometimes "porpoise" if the tilt of the motor is incorrect.

It is also well known that manually tilted motors are mounted upon the transom of a boat by the use of a transom bracket, with an upper portion of the transom bracket forming a pivotal support for the outboard motor. The transom bracket may be equipped with a spaced pair of stern brackets each containing a series of spaced holes, with each hole of one of the stern brackets being in alignment with a corresponding hole in the other of the stern brackets. An elongate pin is adapted to extend between a selected, aligned pair of spaced holes, with a forward portion of the drive shaft housing of the outboard motor defining a saddle member that will fit between the stern brackets and contact the elongate pin.

When the outboard motor is providing power and the boat is underway, the saddle member presses firmly against a mid portion of the elongate pin, thus to establish a tilt angle of the drive shaft housing of the outboard motor with respect to the transom of the boat. If the boater finds that the boat performs improperly, it is well known that he should stop the boat, remove the elongate pin from the present pair of holes, and then reinsert the pin in an adjacent pair of holes, thus to change the trim of the motor, hopefully in the proper direction.

Unfortunately, the spaced pairs of aligned holes can be grouped no closer together than a certain extent, for should the manufacturer attempt to move the holes too close together, there would be insufficient wall strength or thickness to withstand the thrust of the motor when the boat is underway.

It was to overcome this problem, and to make fine grain adjustments of motor trim angle possible that brought about the evolution of the present invention.

SUMMARY OF THE THIS INVENTION

The present invention advantageously makes possible the very fined adjustments of the angular relationship between the drive shaft housing of an outboard motor, and the transom of the boat. Because of its unique nature, the present invention makes it possible for the boater to make tilt adjustments of the outboard motor that are more minute than the spacing of the holes in which the elongate tilt angle pin is placed. As a result, these holes can be spaced further apart for more adequate metal strength.

A motor bracket utilized in conjunction with my invention utilizes a transom bracket means adapted to be mounted on the transom of a boat, with this transom bracket means including a pair of stern brackets mounted in spaced relation on the transom, The transom bracket means has an upper portion in which is defined a pivotal support for the outboard motor, with the lower portions of the stern brackets each containing a series of spaced holes in which each hole in one of the stern brackets is in alignment with a corresponding hole in the other of the stern brackets. All of these holes associated with the adjustment of motor tilt with respect to the transom of the boat, known as trim adjustment holes, are approximately located upon an arc swung with the pivotal support as its center.

As is well known, it is customary to insert an elongate pin in a selected, aligned pair of spaced holes located in the stern brackets, with a forward portion of the drive shaft housing of the outboard motor, known as a saddle member, being adapted to press tightly against a mid portion of the elongate pin when the boat is underway and the motor is providing power.

The boater may be able to correct the trim of the boat in accordance with the conventional technique, by stopping the boat, withdrawing the elongate pin, and placing it in a more appropriate aligned pair of holes, but then again, he will not be able to accomplish proper trim of the boat when the proper angular relationship between drive shaft housing and transom may be regarded as being somewhere between two adjacent sets of aligned holes in the stern brackets.

In accordance with the specific details of this invention, upon being confronted with a situation of this latter type, the boater stops the boat and removes the elongate pin from the trim adjustment holes. However, instead of inserting the pin in the next adjacent pair of aligned adjustment holes, which would in this instance provide too much correction, he follows a different procedure in accordance with a preferred embodiment of this invention. After inserting the pin through the same hole in one stern bracket, he then inserts a hollow sleeve of proper length and proper wall thickness over the elongate pin before inserting the pin in the corresponding hole in the other stern bracket. In this way the boater is able to achieve a slight change in the effective diameter of the elongate pin, and thereby bring about a more minute change of the motor tilt than would be possible if he merely replaced the pin in the next pair of aligned trim adjustment holes.

Quite advantageously, the trim adjustment holes can now be spaced further apart than usual as a result of this invention, with this enabling the stern brackets to possess greater metal strength.

In accordance with another embodiment of my invention, the use of complete sleeves is obviated, and split sleeves are utilized. These split sleeves are used in pairs, with the inner portion of each half sleeve being recessed longitudinally so that it can lie closely against the elongate pin. A pair of split sleeves of approximately the same length and wall thickness are mounted on a form of spring clip, so that they will be maintained closely together when not in use, and held closely against the mid portion of elongate pin when they have been placed around the pin for utilization in the motor trimming operation.

It is therefore to be seen that the various options available in accordance with this invention make it possible for the boater to selectively increase, to a slight degree, the effective diameter of the elongate pin, against which the saddle member presses when the motor is delivering power.

As is obvious, the boater can have several hollow sleeves or split sleeves of varying wall thickness always available, so that he can achieve the desired minute motor tilt adjustment merely by selecting the sleeve having the most appropriate wall thickness for the particular situation at hand. In that way he can bring about improved performance and improved handling of the boat at selected speeds.

In this way, the problem of trim adjustment holes not being close enough together has been circumvented, with this being accomplished in a most inexpensive yet highly effective way.

A primary object of my invention is therefore to provide fine grain tilt adjustments of a manually tilted outboard motor, accomplished at a minimum of expense.

Another object of my invention is to provide an improved motor mounting bracket for an outboard motor wherein it is unnecessary for the manufacturer to attempt to place trim adjustment holes closer together than a certain extent.

It is still another object of my invention to provide a technique for enabling the trim of a boat to be modified very slightly when needed, so as to assure improved performance and improved handling of the boat at selected speeds.

It is yet another object of my invention to provide a procedure enbabling the effective diameter of the elongate pin used with the trim adjustment holes of an outboard motor to be readily modified to a desired extent.

It is yet still another object of my invention to provide a motor mounting arrangement involving a plurality of pairs of aligned holes, between a selected pair of which, a pin of easily modified effective diameter can be received.

These and other objects, features and advantages will be more apparent as the description proceeds.

DESCRIPTION OF PREFERRED EMBODIMENT

Figure 1:
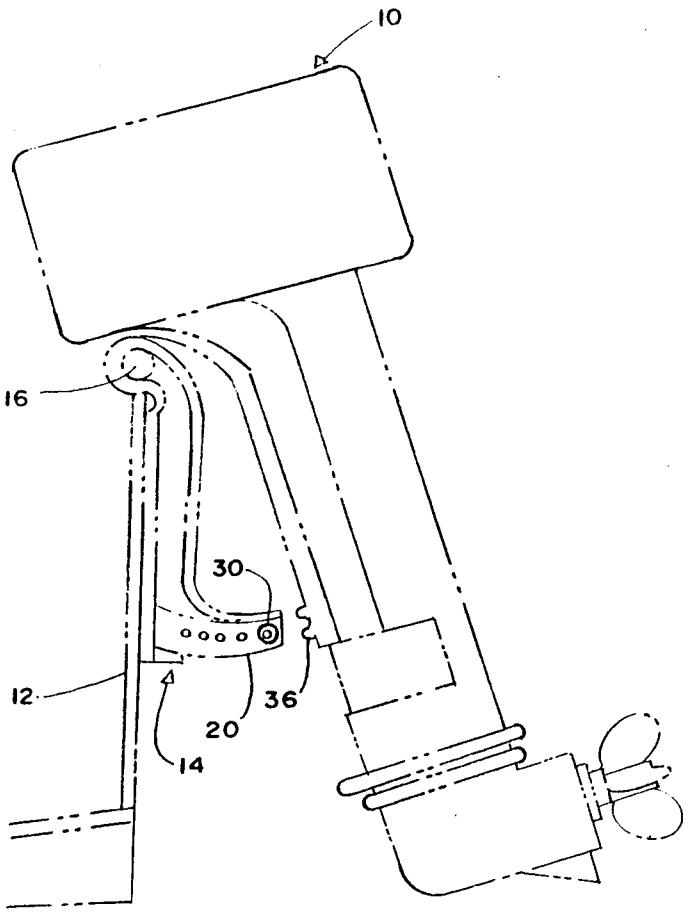
FIG. 1 is a side elevational view showing an outboard motor tilted slightly away from the position in which a portion of the drive shaft housing makes contact with the elongate pin extending between stern bracket holes.

Turning to FIG. 1, it will there be seen that I have provided an outboard motor 18, that is tiltably and steerably mounted upon the transom 12 of a boat. The proper mounting of the motor is made possible by a transom bracket means 14, which has in its upper portion, a pivotal support 16 for the motor, about which desired tilting movements of the motor can be accomplished.

The transom bracket is ordinarily mounted on the centerline of the boat, but in the event a pair of outboard motors are mounted on the transom, the transom brackets are mounted equidistant from the center of the transom.

The transom bracket means 14 also includes a pair of stern brackets 20 and 22, that are mounted a spaced distance apart, being symmetrically placed with respect to the vertical centerline of the drive shaft housing 28 of the motor. The stern brackets 20 and 22 are best seen in FIG. 2.

Figure 2:
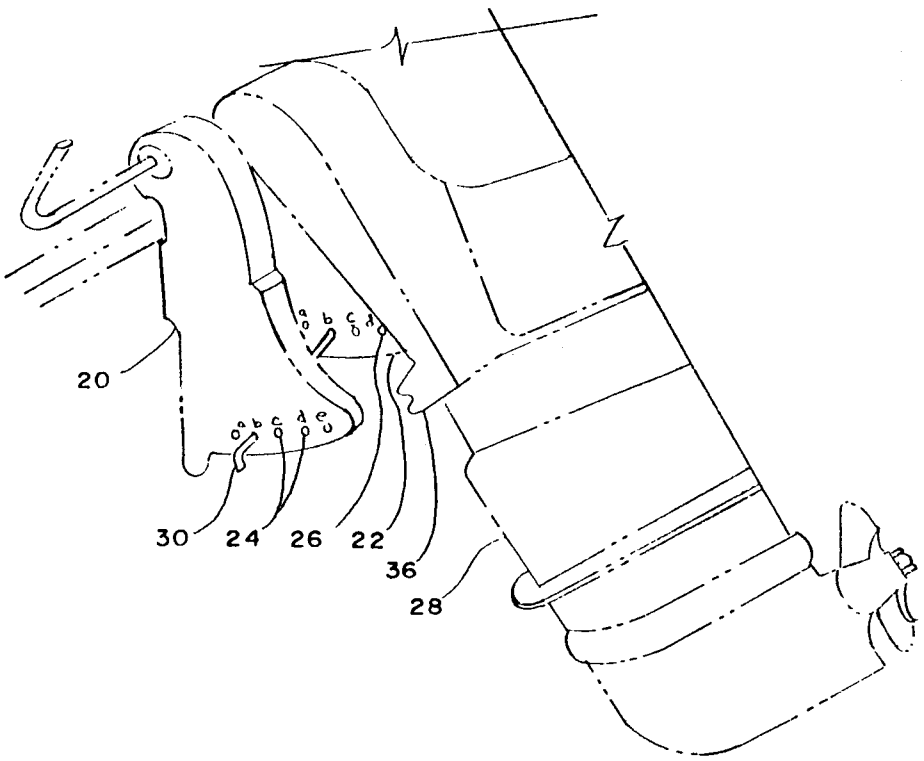
FIG. 2 is a perspective view similar to FIG. 1 but revealing the elongate pin against which the saddle member or members of the motor shaft housing press when the boat is underway.

Each of the pair of stern brackets contains in its lower portion, a series of spaced holes concerned with trim adjustment, with the series of trim adjustment holes 24 for stern bracket 20 being fully visible in FIGS. 1 and 2, and the series of trim adjustment holes 26 for stern bracket 22 being only partially visible in FIG. 2.

All of the trim adjustment holes 24*a, b, c, d* and *e*, and 26*a, b, c, d* and *e* are located on an arch swung about the pivotal support 16, and it is important to note that each of the holes 24 in stern bracket 20 are in careful alignment with each corresponding hole in stern bracket 22, for this arrangement permits the boater to insert an elongate pin 30, also known as a pin-lock bolt, between an aligned pair of holes located in the respective stern brackets 20 and 22, as will be noted in FIG. 2. This is known art, and likewise it is well known that upon a boater finding that his boat is improperly trimmed, he can stop the boat, remove the elongate pin 30, and insert it into an adjacent aligned pair of adjustment holes before resuming his motor boat ride.

It is also well known to provide on a forward portion of the drive shaft housing 28, a saddle member 36, visible in FIGS. 1 and 2, with this member being designed to contact portions of the steel pin 30 at two locations between the brackets. The saddle member is typically in the form of two concave prongs that contact the pin at locations quite close to the brackets at such time as the pin is extending between an aligned pair of trim adjustment holes. When the boat is underway and the motor is supplying power, the prongs of the saddle member 36 press firmly against inner portions of elongate pin 30, with this pin in effect serving to control, by virtue of its thickness and its particular placement or positioning in the adjustment holes, the angle the drive shaft housing 28 of the motor bears to the transom 12 of the boat. Quite obviously, the left-right dimension of the saddle member 36 is such that is can reside between the stern brackets 20 and 22 when the motor is supplying power for the forward propulsion of the boat.

Because a considerable amount of thrust or forward force is applied to the mid portion of the elongate pin 30 by the saddle member 36, it is obvious that the stern brackets 20 and 22 must be made of relatively thick material, such as cast or forged aluminum, cast or forged steel, or other such suitable material. It should also be clear that the trim adjustment holes in the stern brackets 20 and 22 must not be mounted too close together. Otherwise, if the holes were exceedingly close together, the strength of the metal between adjacent holes might well fail when power is applied by the motor to the boat's transom.

It is unfortunate from the standpoint of achieving proper boat trim, that the trim adjustment holes in the stern brackets 20 and 22 cannot be exceedingly close together, for often a boater fined that when the elongate pin 30 is in one set of holes, the up trim is insufficient, whereas when the pin 30 is in the very next pair of aligned holes, the up trim is too great.

Figure 3A:
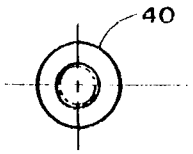
FIG. 3*a* is a cross-sectional view of the sleeve of FIG. 3 in place on the elongate pin.
Figure 3:
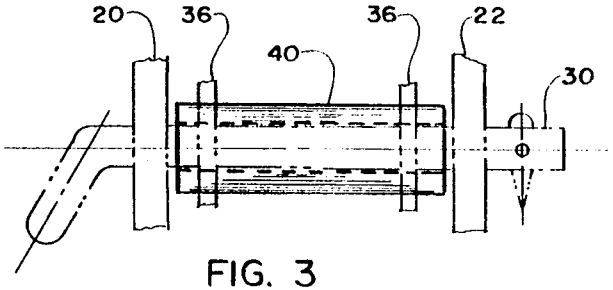
FIG. 3 reveals a hollow sleeve of considerable thickness in place on the elongate pin.

My invention comes into play at a time like this, for by the use of a selected hollow tube or sleeve 40 placed upon a mid portion of the elongate pin 30, as shown in FIGS. 3 and 3*a*, the trim of the motor can be adjusted very minutely, with the amount of the adjustment being in accordance with the wall thickness of that particular hollow sleeve. In the instance at hand, the wall thickness of the sleeve 40 is comparatively large, but not so large as to represent an apparent increase in pin diameter to be the equilavent to moving the pin 30 to the next set of trim alignment holes in the stern brackets.

Figure 4A:
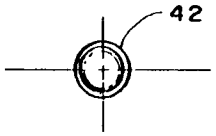
FIG. 4*a* is a cross sectional view of the sleeve of FIG. 4 in place on the elongate pin.
Figure 4:
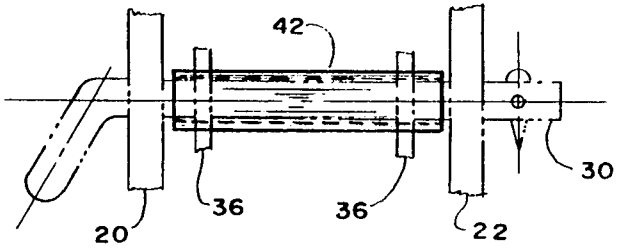
FIG. 4 shows a hollow sleeve of substantially less thickness than was used in FIG. 3, in place on the elongate pin.

In FIG. 4 and 4*a* I reveal the use of a hollow tube or sleeve 42 having a comparatively thin sidewall, which is the sleeve to which the boater may resort upon finding the wall thickness of sleeve 40 gave to much pin diameter increase, or in other words, provided too much correction.

It is obvious that I am not to be limited to any particular materials or thicknesses, but by way of example, the boater could have on hand a number of similar cylindrical tubes or sleeves, varying in wall thicknesses such as 0.5 mm, 1 mm, 1.5 mm, 2 mm, 2.5 mm, and so forth up to say 10 mm, or even 20 mm. Any of a number of hard durable materials could be used, such as non-corrosive metal, plastic, ceramic, or even wood in some instances.

As should now be clear, my invention permits the trim alignment holes to be spaced more widely apart then was previously possible, with greater metal strength thus being made possible.

Figure 5A:
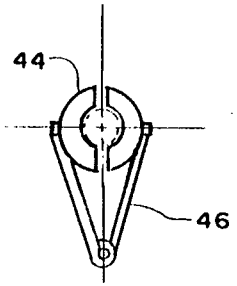
FIG. 5*a* is a cross-sectional view of the split sleeve embodiment of FIG. 5.
Figure 5:
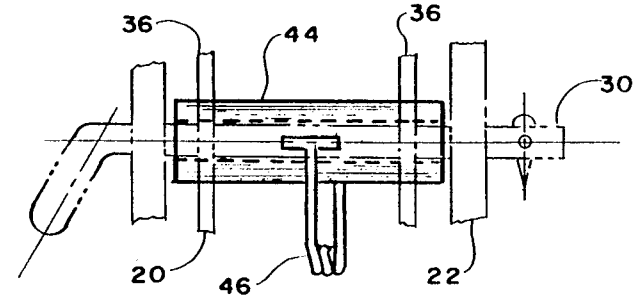
FIG. 5 reveals a different type of sleeve in place on the elongate pin, in this instance being a split sleeve embodiment, with the two halves of the split sleeve held together by a spring clip means.

I am not to be limited to sleeves that make a complete circle, for it is possible to design the sleeves in two elongate halves of the same length, as shown in FIGS. 5 and 5*a*. Each half of the split sleeve device 44 is approximately 180 degrees in extent, having a recessed inner portion such that it conforms to the pin 30, and being mounted on what may be regarded as a form of spring clip 46. Thus, the boater would not need to partially remove the pin 30, that is, pull it out of the stern bracket on one side in order to add the sleeve. This is because when utilizing the "split-sleeve" embodiment, the boater, after manually raising the motor, could merely clip a device 46 in accordance with the configuration of my invention shown in FIGS. 5 and 5*a*, into place on the pin 30, and then lower the motor and motor housing back into contact with the pin 30. As in the other embodiments of my invention, the split-sleeve devices 46 will be available to the boater in various wall thicknesses. The split sleeves may be made from any number of durable materials such as steel, cast iron, copper, plastic, ceramic, or the like.

As should now be apparent, the boater may wish to carry along a suitable assortment of tubes or sleeves of varying thickness in accordance with the selected embodiment of my invention, so that he can achieve minute and precise trim adjustments of his boat equipped with an outboard motor, with a minimum of effort and expense.

Because my invention makes it possible for the boater to readily achieve the correct trip of the drive shaft housing of the motor with respect to the transom of the boat, he can be assured with respect to the transom of the boat, he can be assured of improved performance and improved handling at selected speeds.

My invention can also be used to advantage when adjusting the motor-to-boat trim on boats fitted with outboard motors that have power trim mechanisms. Most manufacturers provide paired brackets equipped with paired holes, so that an elongate pin be inserted manually into the appropriate holes of the stern brackets at such time as the electric motor or the hydraulic system of the power trim unit has failed. As is obvious, either the hollow sleeves or the split sleeves may be used in this instance.

I claim:

1. A mounting bracket arrangement for boat powered by an outboard motor having an elongate shaft housing, such that very slight increases in the tilt angle of the motor are made possible, said arrangement comprising a transom bracket means adapted to be mounted on the transom of a boat, said transom bracket means including a pair of stern brackets mounted in equally spaced relation on the transom of a boat, with the lower portions of said stern brackets each containing a spaced series of trim adjustment holes, with each hole in one of said stern brackets being in alignment with a corresponding hole in the other of said stern brackets, an elongate pin adapted to extend through any selected, aligned pair of spaced holes in said stern brackets, with a portion of the shaft housing of the outboard motor defining a saddle member designed to contact a portion of said elongate pin at a location between the inner walls of said stern brackets, with said elongate pin withstanding a substantial part of the forward thrust applied by said saddle member when the outboard motor is delivering power, the boater being able to apply fine grain corrective forces for trimming the boat when the boat is at rest by placing a sleeve of preascertained wall thickness over said pin, said sleeve only slightly increasing the effective diameter of the elongate pin, and thus only slightly increasing the distance between the center of said elongate pin and said saddle member, thereby only slightly increasing the tilt angle of the motor with respect to the transom of the boat, and resulting in improved performance and improved handling of the boat at selected speeds after the correct sleeve of proper thickness is fitted.

2. The mounting bracket arrangement as recited in claim 1 in which are provided a plurality of hollow sleeves of varying wall thicknesses, so that a sleeve of the wall thickness appropriate for meeting a particular need can be inserted over the elongate pin.

3. The mounting bracket arrangement as recited in claim 1 in which said sleeve is of split construction, involving elongated halves of similar length and wall thickness.

4. The mounting bracket arrangement as recited in claim 3 in which clip means are utilized for holding said elongate halves in operative relationship.

5. A mounting bracket arrangement for the transom of a boat, enabling precise mechanical tilt adjustments for an outboard motor having a pivotal motor and drive shaft housing, and also comprising a transom bracket means adapted to be mounted on the transom of a boat, said transom bracket means including a pair of stern brackets mounted in spaced relation on the transom of a boat, said transom bracket means having an upper portion in which is defined a pivotal support for an outboard motor, with the lower portions of said stern brackets each containing a series of spaced holes, with each hole in one of said stern brackets being in alignment with a corresponding hole in the other of said stern brackets, with all of said holes being located on an arc swung with said pivotal support as its center, an elongate pin adapted to extend through and rest between a selected, aligned pair of spaced holes of said stern brackets, with a forward portion of the drive shaft housing of the outboard motor defining a saddle member having a dimension such that it will fit between said stern brackets, with said saddle member being designed to contact the mid portion of said elongate pin, with said saddle member providing a large part of the forward thrust created when the outboard motor is propelling the boat through the water, the user being able to apply gross corrective trim forces affecting the performance attitude of the boat by moving the elongate pin to a different aligned pair of spaced holes in said stern brackets when the boat is at rest, but being able to apply fine grain corrective trim forces by placing a sleeve of preascertained wall thickness over said pin, such that said sleeve will but slightly increase the distance between the center of said elongate pin and said saddle member, and thus only slightly increase the tilt angle of the motor with respect to the transom of the boat, and thereby achieve improved performance and improved handling of the boat at selected speeds, after the corrective sleeve of proper thickness has been utilized.

6. The mounting bracket arrangement as recited in claim 5 in which are provided a plurality of hollow sleeves of varying wall thicknesses, so that a sleeve of the wall thickness appropriate for meeting the particular need can be inserted over the elongate pin.

7. The mounting bracket arrangement as recited in claim 5 in which said sleeve is of split construction, involving elongate halves of similar length and wall thickness.

8. The mounting bracket arrangement as recited in claim 7 in which clip means are utilized for holding said elongate halves in operative relationship.

9. A mounting bracket arrangement for a boat powered by an outboard motor having an elongate shaft housing, such that very slight increases in the tilt angle of the motor are made possible, said arrangement comprising a transom bracket means adapated to be mounted on the transom of a boat, said transom bracket means including a pair of stern brackets mounted in equally spaced relation on the transom of a boat, with the lower portions of said stern brackets each containing a spaced series of trim adjustment holes, with each hole in one of said stern brackets being in alignment with a corresponding hole in the other of said stern brackets, an elongate pin adapted to extend through any selected, aligned pair of spaced holes of said stern brackets, with a portion of the shaft housing of the outboard motor defining a saddle member designed to contact a portion of said elongate pin at a location between the inner walls of said stern brackets, with said elongate pin withstanding a substantial part of the forward thrust applied by the saddle member when the outboard motor is delivering power, the improvement being the combination of a series of sleeves of varying thickness selectively used with said elongate pin, such that the boater is able to apply fine grain corrective forces for trimming the boat when the boat is at rest by placing a selected sleeve of preascertained wall thickness over said elongate pin, said sleeve only slightly increasing the effective diameter of said elongate pin, and thus only slightly increasing the distance between the center of said elongate pin and said saddle member, and as a consequence, thereby only slightly increasing the tilt angle of the motor with respect to the transom of the boat, and resulting in improved performance and improved handling of the boat at selected speeds after the correct sleeve of proper thickness has been fitted.

10. The mounting bracket arrangement as recited in claim 9 in which at least one of said sleeves is of split construction, involving elongate halves of similar length and wall thickness.

* * * * *